US009133992B2

(12) United States Patent
Lee

(10) Patent No.: US 9,133,992 B2
(45) Date of Patent: Sep. 15, 2015

(54) PORTABLE ELECTRIC CANDLE HAVING A LAMP PENDULATING AND ROTATING SIMULATANEOUSLY

(71) Applicant: Chong Ceul Lee, Seoul (KR)

(72) Inventor: Chong Ceul Lee, Seoul (KR)

( * ) Notice: Subject to any disclaimer, the term of this patent is extended or adjusted under 35 U.S.C. 154(b) by 0 days.

(21) Appl. No.: 14/364,421

(22) PCT Filed: Dec. 10, 2012

(86) PCT No.: PCT/KR2012/010716

§ 371 (c)(1),
(2) Date: Jun. 11, 2014

(87) PCT Pub. No.: WO2013/089401

PCT Pub. Date: Jun. 20, 2013

(65) Prior Publication Data

US 2014/0362592 A1 Dec. 11, 2014

(30) Foreign Application Priority Data

Dec. 12, 2011 (KR) ..... 10-2011-0133186

(51) Int. Cl.

| | |
|---|---|
| ***F21L 4/04*** | (2006.01) |
| ***F21L 4/08*** | (2006.01) |
| ***F21V 14/02*** | (2006.01) |
| ***F21S 10/04*** | (2006.01) |
| ***F21S 6/00*** | (2006.01) |
| *F21W 121/00* | (2006.01) |
| *F21Y 101/02* | (2006.01) |
| *F21Y 113/00* | (2006.01) |

(52) U.S. Cl.

CPC ... *F21L 4/04* (2013.01); *F21L 4/08* (2013.01); *F21S 6/001* (2013.01); *F21S 10/046* (2013.01); *F21V 14/02* (2013.01); *F21W 2121/00* (2013.01); *F21Y 2101/02* (2013.01); *F21Y 2113/005* (2013.01)

(58) Field of Classification Search

None

See application file for complete search history.

(56) References Cited

U.S. PATENT DOCUMENTS

| | | | | |
|---|---|---|---|---|
| 4,551,794 | A * | 11/1985 | Sandell | 362/392 |
| 8,646,946 | B2 * | 2/2014 | Schnuckle et al. | 362/277 |
| 2013/0050985 | A1 * | 2/2013 | Kwok et al. | 362/96 |
| 2013/0242579 | A1 * | 9/2013 | Patton et al. | 362/393 |

FOREIGN PATENT DOCUMENTS

| | | |
|---|---|---|
| JP | 2002-170410 | 6/2002 |
| KR | 1989-0002119 | 4/1989 |
| KR | 20-0246825 | 11/2001 |
| KR | 20-0255417 | 12/2001 |
| KR | 10-2010-0128775 | 12/2010 |

* cited by examiner

*Primary Examiner* — Ashok Patel

(74) *Attorney, Agent, or Firm* — LEX IP Meister, PLLC

(57) ABSTRACT

Disclosed is a portable electric candle having a lamp pendulating and rotating simultaneously, including: a lamp unit (10) having a lamp (12), a weight (18), and a permanent magnet (19), wherein the lamp unit (10) can perform a pendulating motion using both a magnetic force and a repulsive force and repeats the pendulating motion using a restoring force; a rotator (20) including a cylindrical base (22), an inner container body (24), a contact terminal (26), the electromagnet (27), a magnetized body (28), and a power supply terminal part (29); a rotator housing (30) for inducing a rotation of the rotator (20) therein; and a motion selecting switch (102) for selecting a motion of the lamp (12) so as to perform one of a rotating motion and a pendulating motion selectively or to perform both the rotating motion and the pendulating motion simultaneously.

9 Claims, 6 Drawing Sheets

(가)

(나)

(다)

PORTABLE ELECTRIC CANDLE HAVING A LAMP PENDULATING AND ROTATING SIMULATANEOUSLY

TECHNICAL FIELD

The present invention relates, in general, to an electric candle having a lamp electrically operated to emit light and, more particularly, to a portable electric candle having a lamp able to pendulate and rotate simultaneously, which is controlled to induce a pendulating motion of the lamp and to induce the lamp to rotate separately from or simultaneously with the pendulating motion, and in which the brightness and color of light can be changed and a preset operating time can be adjusted.

BACKGROUND ART

A candle made of a flammable solid material, such as paraffin, cannot continuously give light for a lengthy period time, requires careful handling and may cause a fire. Thus, electric candles that can be easily and safely turned on or turned off without causing a fire have been proposed and are used.

An example of technologies relating to the present invention may be referred to Korean Utility Registration No. 20-0248825. This technology provides an electric candle, including: a lamp unit; a body part having extensions that are connected to a light bulb and extend outward in diametrically opposite directions, with an electric contact part provided on each of the extensions and a pendulum provided in the lower end of the body part; a candle casing; a safety cover provided on the upper end of the candle casing and provided therein with a longitudinal hole extending in a first direction; and first and second conductive parts provided in the candle casing at diametrically opposite locations below the safety cover and connected to a power source, wherein the contact parts of the lamp unit can be brought into electric contact with the first and second conductive parts in such a way that, when the first and second conductive parts are arranged in a first direction, the body part of the lamp unit can be inserted into the longitudinal hole so as to come into electric contact with the first and second conductive parts, and, when the first and second conductive parts are arranged in a second direction that is angularly spaced apart from the first direction, the body part of the lamp unit cannot be inserted into the longitudinal hole.

However, the above-mentioned technology is problematic in that the lamp of the lamp unit is configured to repeat a pendulating motion, so the lamp fails to accurately simulate an active flame. Further, when a user views the pendulating lamp in the same direction as a swinging direction of the pendulum, the user may not be aware of the swinging motion of the flame-simulating lamp.

DOCUMENTS OF RELATED ART (Patent Document 1) Korean Utility Model Registration No 20-0255417 discloses "portable candle apparatus having appearance like a candle". This candle apparatus includes: a first cylindrical body having a predetermined receiving space in the upper end thereof, first and second cylindrical body lead wires extending axially and downwardly along the outer surface of the first cylindrical body having the receiving space such that the lead wires protrude downward from the lower end of the first cylindrical body, an electromagnet provided in the lower part of the first cylindrical body, and an insulating tape closely wrapped around the outer circumferential surface of the electromagnet so as to prevent contact between the electromagnet and the cylindrical body lead wires; a PCB engaged with the first and second cylindrical body lead wires at opposite upper corners thereof and provided at a lower end thereof with a first contact terminal connected to the first cylindrical body lead wire and a second contact terminal connected to the second cylindrical body lead wire; a second cylindrical body receiving the first cylindrical body therein, with hooks protruding on opposite sides of the upper end of the outer circumferential surface thereof, and with a stop ring formed around a lower part of the outer circumferential surface thereof; a lamp unit provided with a lamp formed on the upper end of the lamp unit, a weight mounted to the lower end of the lamp unit and received in the receiving space of the first cylindrical body, a permanent magnet mounted to the lower surface of the weight, a wing protruding radially outward from the lamp unit at a location between the lamp and the weight, and a conductive wire mounted to the lower surface of the wing such that the conductive wire comes into contact with the cylindrical body lead wires; a safety cap provided in the upper end thereof with an opening for receiving the weight and the wing of the lamp unit, and locking slots formed on opposite sides of the upper end of the safety cap so as to be engaged with the respective hooks of the second cylindrical body; a third cylindrical body composed of detachable first and second bodies, with locking grooves formed on the upper ends of the inner circumferential surfaces of the first and second bodies so as to be engaged with the stop ring of the lower part of the outer circumferential surface of the second cylindrical body, a battery receiving space defined inside the first and second bodies by upper and lower partition plates, elastic lead coils provided on the lower surface of the upper partition plate and on the upper surface of the lower partition plate, respectively, so as to come into contact with positive and negative poles of a battery, a battery inlet formed by the lower ends of the first and second bodies so as to receive a battery into the battery receiving space, a switch protruding outward in the lower end of the outer circumferential surface of the first and second bodies so as to control electric power of the battery received in the battery receiving space, and third and fourth contact terminals provided on opposite sides of the lower ends of the outer circumferential surfaces of the first and second bodies; a plurality of conductive wires for supplying electricity of the battery or commercial electricity to the PCB; a fourth cylindrical body receiving the first cylindrical body, the second cylindrical body and the third cylindrical body therein; an actuating cylindrical body, the upper end of which is combined with the lower end of the fourth cylindrical body, and which is provided with a vertical switch slot for receiving the switch therein; and a contact piece combined with the lower end of the outer circumferential surface of the actuating cylindrical body and provided, the contact piece being vertically slit, with a plurality of elastic blades formed on the outer circumferential surface of the contact piece at regular intervals.

(Patent Document 2) The technology disclosed in patent document 1 is problematic in that the lamp of the lamp unit is configured to repeat a pendulating motion, so the lamp fails to accurately simulate an active flame. Further, when a user views the pendulating lamp in the same direction as a swinging direction of the pendulum, the user may not be aware of the swinging motion of the lamp.

DISCLOSURE

Technical Problem

Accordingly, the present invention has been made keeping in mind the above problems occurring in the prior art, and an object of the present invention is to provide a portable electric candle having a lamp able to pendulate and rotate simultaneously, in which the lamp is configured to perform a pendulating motion and a 360 degree angle rotating motion simultaneously, so the lamp can swing irrespective of viewing directions of a user and can better approximate a natural flame.

Another object of the present invention is to provide a portable electric candle having a lamp able to pendulate and rotate simultaneously, which is controlled to induce a pendulating motion of the lamp and to induce the lamp to rotate separately from or simultaneously with the pendulating motion, and in which the brightness and color of light can be changed and a preset operating time can be adjusted.

Technical Solution

In order to accomplish the above objects, an embodiment of the present invention provides a portable electric candle having a lamp pendulating and rotating simultaneously, comprising:

a lamp unit including: a lamp held by a conductive wire of a wing and emitting light by electricity supplied thereto from a power source, a weight mounted to a lower end of the wing, and a permanent magnet provided in a lower part of the weight and corresponding to an electromagnet of a rotator, wherein the lamp unit performs a pendulating motion using both a magnetic force produced by an electric current applied to the electromagnet and a repulsive force produced by the permanent magnet and repeats the pendulating motion using a restoring force produced by the weight;

the rotator including: a cylindrical base, an inner container body extending upward from the cylindrical base and having an opening that is open upward, a contact terminal placed in an upper end of the inner container body and electrically connected to the conductive wire, the electromagnet provided on a center of an upper surface of the cylindrical base, a magnetized body mounted in an outer circumferential surface of the inner container body and producing a magnetic flux, and a power supply terminal part mounted to a lower part of the inner container body, wherein the rotator is rotated by a force that is formed by a magnetic force of a field coil of a rotator housing in combination with the magnetic flux produced by the magnetized body;

the rotator housing including: a bearing receiving part, an outer container body extending upward from the bearing receiving part and having a cylindrical opening for receiving the rotator therein, and the field coil mounted on an inner circumferential surface of the outer container body, wherein the rotator housing receives the rotator therein, and induces a rotation of the rotator therein; and a motion selecting switch configured to select a motion of the lamp in such a way that the lamp performs one of a rotating motion and the pendulating motion selectively or performs both the rotating motion and the pendulating motion simultaneously.

The portable electric candle may further include: a timer configured to control an operating time of the lamp during which the lamp performs the rotating motion and the pendulating motion.

Further, the lamp may be a color changeable LED lamp configured to change lighting color using R (Red), G (Green) and B (Blue) colors.

Further, the lamp may be connected to an LED current controller in such a way that the lamp and the LED current controller form a circuit capable of controlling brightness of the lamp stepwisely.

Further, to use the electric candle as a portable candle configured to be moved to a table in a marriage ceremony hall or to an event hall, a power source that supplies electricity to the conductive wire, the electromagnet and the field coil may be a rechargeable battery, a primary dry cell or a rechargeable dry cell which is installed in a candle body.

Further, to supply electricity of an external power source to the conductive wire, the electromagnet and the field coil, a plug may be connected to the electric candle.

Further, the portable electric candle may further include: a rotating shaft mounted to a central axis of the power supply terminal part, the rotating shaft being inserted into the rotator housing and maintaining concentricity.

Further, the portable electric candle may further include: a bearing provided on an upper surface of the bearing receiving part so as to support a rotation of the rotator.

Further, the rotator housing may be provided with a conductive spring wire that is in elastic contact with the power supply terminal part of the rotator so as to supply electricity of an external power source to the power supply terminal part.

DESCRIPTION OF DRAWINGS

The accompanying drawings are provided only for illustrating preferred embodiments of the present invention, and are intended to allow clear understanding of the spirit and scope of the present invention along with the detailed description, so it should be understood that the present invention is not limited by the accompanying drawings, in which.

Figure 1:
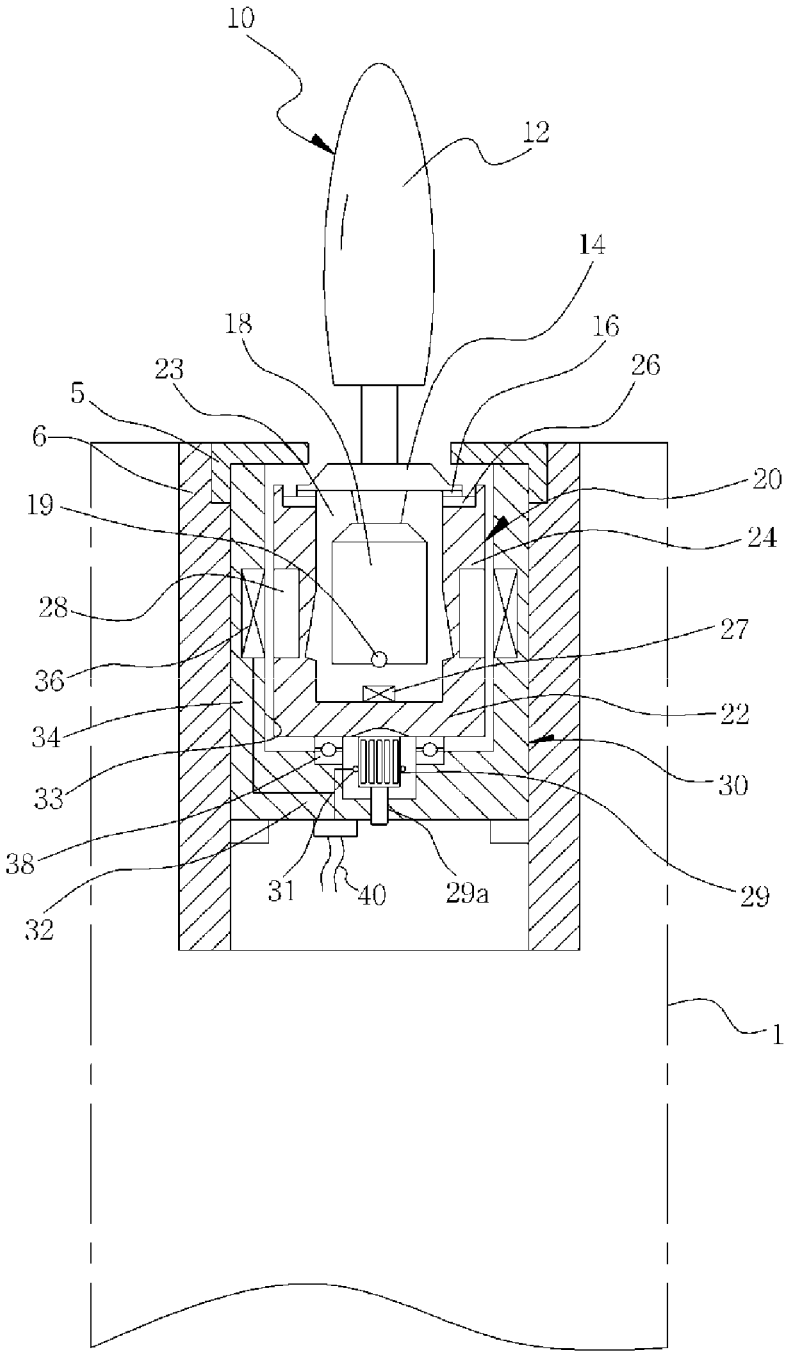
FIG. 1 is a sectional view of an electric candle according to an embodiment of the present invention.

| <Description of the Reference Numerals in the Drawings> | |
|---|---|
| 10: lamp unit | 12: lamp |
| 14: wing | 18: weight |
| 20: rotator | 27: electromagnet |
| 28: magnetized body | 29: power supply terminal part |
| 30: rotator housing | 31: conductive spring wire |
| 36: field coil | 100: control unit |
| 102: motion selecting switch | |
| 104: timer | 106: volume switch |
| 108: color changing switch | |
| 110: LED current controller | |

MODE FOR INVENTION

Hereinbelow, preferred embodiments of the present invention will be described in detail with reference to the accompanying drawings. The embodiments are provided for only the purpose of clear understanding of the present invention, so it should be understood that the present invention is not limited to the embodiments.

Figure 2:
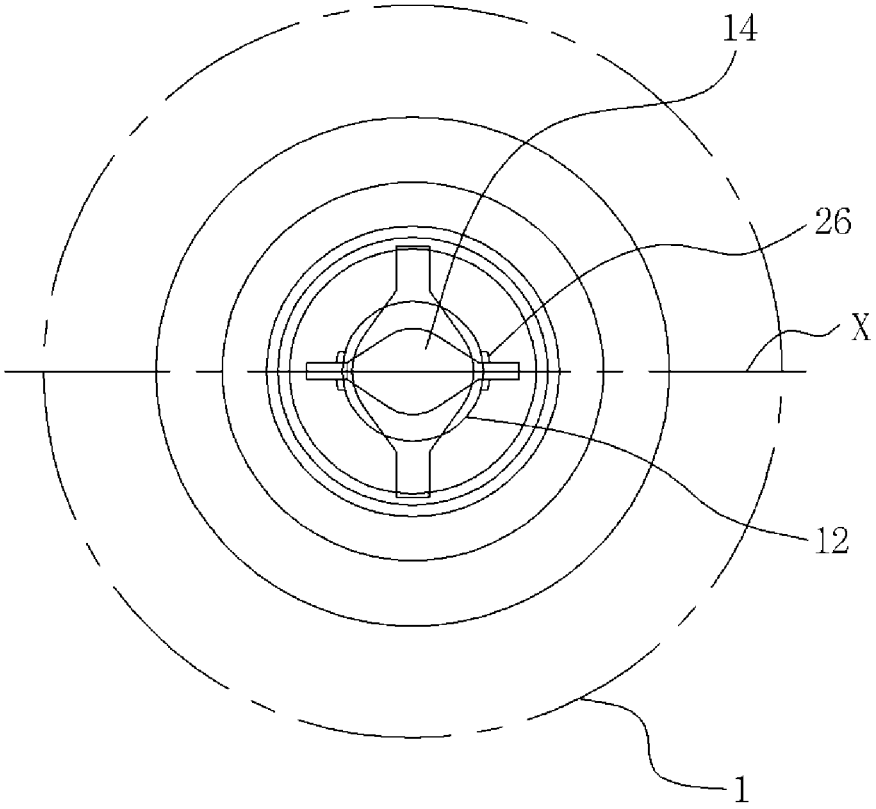
FIG. 2 is a plan view of FIG. 1.
Figure 3:
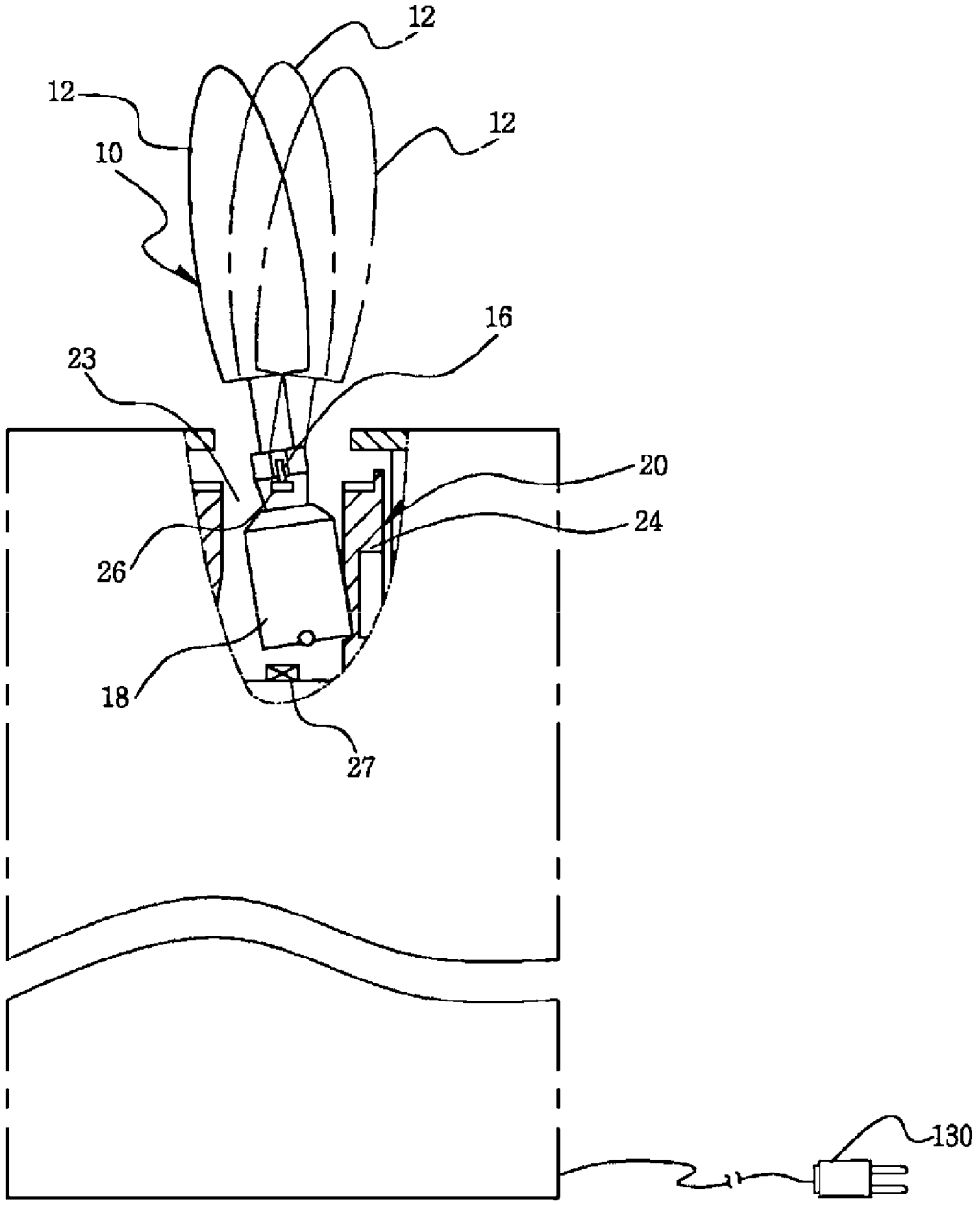
FIG. 3 is a view illustrating a pendulating motion of a lamp of FIG. 1.
Figure 4:
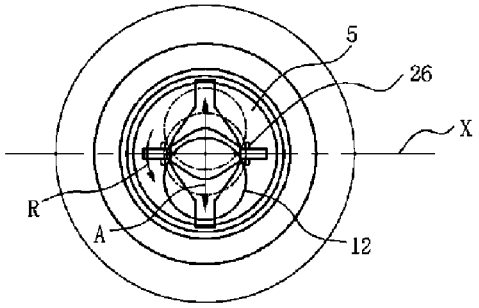
FIG. 4 is a view sequentially illustrating the pendulating motion and a rotating motion of the lamp of FIG. 2.
Figure 4:
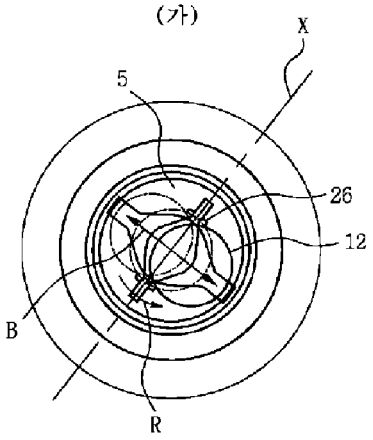
Figure 4:
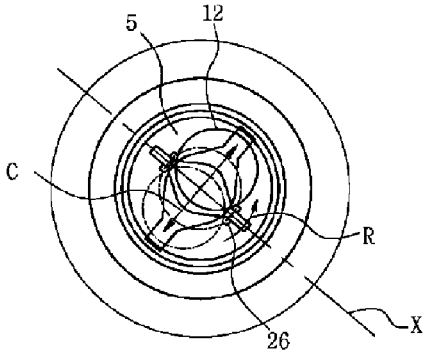
Figure 5:
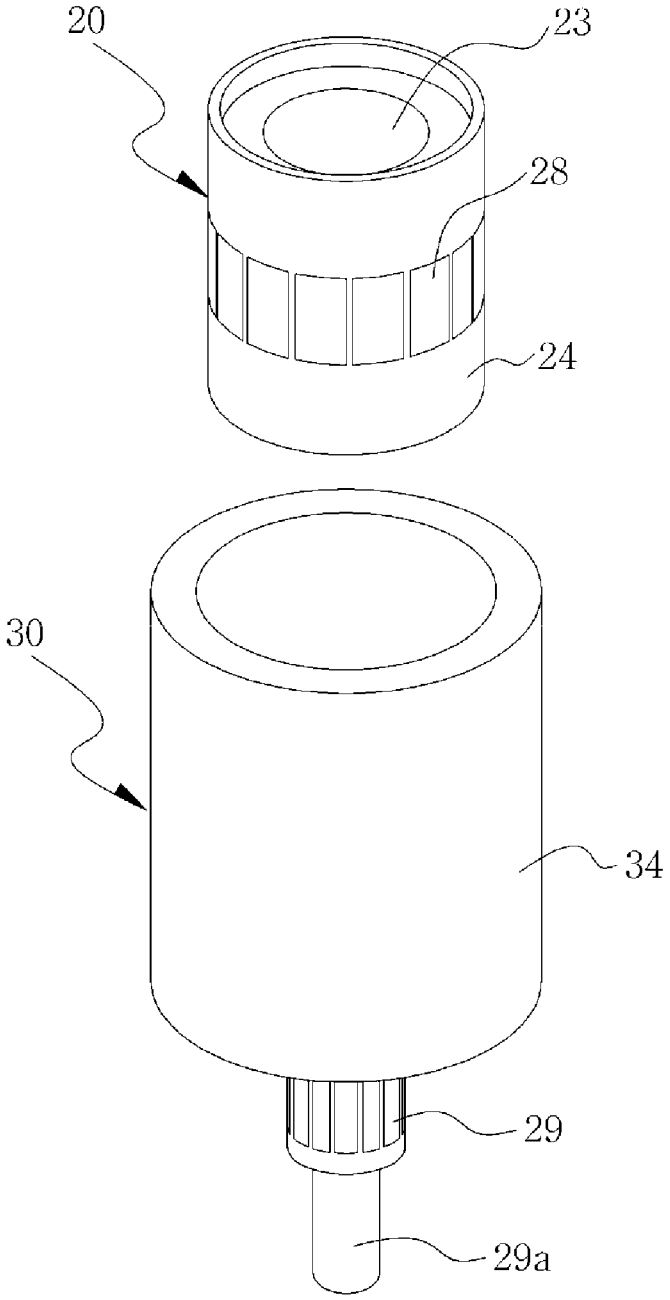
FIG. 5 is an exploded perspective view of a rotator and a rotator housing used in the embodiment of the present invention.

As shown in FIGS. 1, 2 and 5, an electric candle according to an embodiment of the present invention includes: a lamp unit 10 which has a lamp 12 held by a conductive wire 16 of a wing 14 and emitting light using electricity supplied thereto, and performs a pendulating motion by a weight 18 provided in a lower part thereof; a rotator 20 which receives the wing 14 therein and is electrically connected to the conductive wire 16; and a rotator housing 30 which receives the rotator 20 therein, and induces a concentric rotation of the rotator 20 therein using an electromagnetic force.

Here, the conductive wire 16 is electrically connected to the lamp 12 after passing through the wing 14. The weight 18 has a predetermined weight so that the weight 18 can erect the lamp 12 upward and can provide the lamp unit with a restoring force during a pendulating motion of the lamp unit.

The rotator 20 includes: a cylindrical base 22; an inner container body 24 which extends vertically upward from the cylindrical base 22 and has an opening 23 that is open upward; a contact terminal 26 which is placed in the upper end of the inner container body 24 and is electrically connected to the conductive wire 16; a magnetized body 28 which is mounted in the outer circumferential surface of the inner container body 24 and produces magnetic flux; and a power supply terminal part 29 which is mounted to the lower part of the inner container body 24.

Here, it is preferred that the amplitude of the pendulating motion be maintained constant both by an electromagnet 27 provided on the center of the upper surface of the cylindrical base 22 and by a permanent magnet 19 mounted to the lower surface of the weight 18. The weight 18 may be rotatably shafted to the wing 14 such that the amplitude of the pendulating motion can be adjusted.

Terminals are closely formed on the outer circumferential surface of the power supply terminal part 29, and come into contact with a conductive spring wire 31 that will be described later herein. Thus, the power supply terminal part 29 is electrically connected to both the conductive wire 16 and the electromagnet 27, and functions as a circuit for supplying an electric current to both the conductive wire 16 and the electromagnet 27.

Further, a rotating shaft 29*a* may be mounted to the central axis of the power supply terminal part 29. The rotating shaft 29*a* is inserted into the rotator housing 30 and functions as a rotating shaft of the rotator 20.

The rotator housing 30 includes: a bearing receiving part 32; an outer container body 34 extending vertically upward from the bearing receiving part 32 and having a cylindrical opening 33 for receiving the rotator 20 therein; and a field coil 36 mounted on the inner circumferential surface of the outer container body 34.

Here, to efficiently support a rotation of the rotator 20, a bearing 38 may be provided on the upper surface of the bearing receiving part 32.

Further, the rotator housing 30 is provided with the conductive spring wire 31 that is in elastic contact with the power supply terminal part 29 of the rotator 20 so as to supply external electricity to the power supply terminal part 29.

Figure 6:
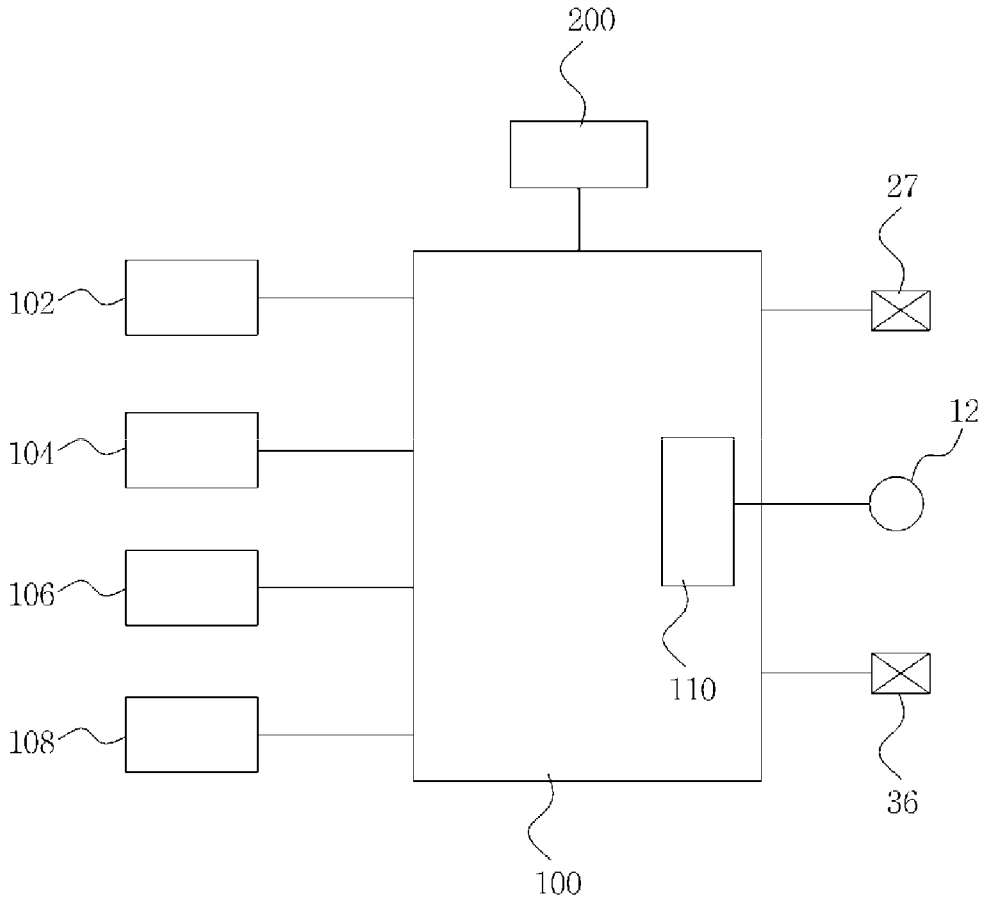
FIG. 6 is a block diagram of a lamp control circuit used in the present invention.

Here, an external power source is electrically connected to both the field coil 36 and the conductive spring wire 31 by an electric wire 40, As shown in FIG. 6, a motion selecting switch 102 is connected to a control unit 100. Here, the motion selecting switch 102 functions to select a motion of the lamp 12 in such a way that the lamp 12 performs one of the rotating motion and the pendulating motion selectively or performs both the rotating motion and the pendulating motion simultaneously. The control unit 100 is electrically connected to the lamp 12. When the motion selecting switch 102 is manipulated to select a pendulating motion, the lamp 12 performs only a pendulating motion. However, when the motion selecting switch 102 is manipulated to select a rotating motion, the lamp 12 performs both the pendulating motion and the rotating motion simultaneously.

Further, a timer 104 may be electrically connected to the control unit 100. Here, the timer 104 functions to control the operating time of the lamp 12 during which the lamp 12 can perform the rotating motion and the pendulating motion. Accordingly, the lamp 12 may emit light and may perform a motion for a lengthy period of time preset by the timer 104.

Here, the lamp 12 may be a color changeable LED lamp that can change lighting color using R (Red), G (Green) and B (Blue) colors in a conventional manner. To form the lamp 12 having the above-mentioned function, a color changing switch 108 may be electrically connected to the control unit 100. Here, the driving voltage of the lamp 12 may be changed by the color changing switch 108, and the lighting color of the lamp 12 may be changed between various colors, thereby creating various lighting moods.

Further, the lamp 12 may be connected to an LED current controller 110 in such a way that the lamp 12 and the LED current controller 110 form a circuit capable of controlling the brightness of the lamp 12 stepwisely. Here, the LED current controller 110 may be included in the control unit 100. To control the brightness of the lamp 12 stepwisely, a volume switch 106 that is electrically connected to the control unit 100 will be used.

Further, the electric candle of the present invention can be used as a portable candle that may be placed on a table in a marriage ceremony hall or in an event hall. When using the electric candle as a portable candle, a rechargeable battery, a primary dry cell or a rechargeable dry cell which is installed in a candle body 1 may be used as a power source 200 that supplies electricity to all of the conductive wire 16, the electromagnet 27 and the field coil 36.

Further, to supply electricity of an external power source to the lamp 12, the conductive wire 16, the electromagnet 27 and the field coil 36, a plug 130 may be connected to the electric candle.

In the accompanying drawings, reference numeral 1 denotes a candle body, numeral 5 denotes a cover, and numeral 6 denotes a candle casing.

The operation of the above-mentioned electric candle according to the embodiment of the present invention will be described hereinbelow.

First, as shown in FIG. 1, electricity of the power source 200 is supplied to the field coil 36, the conductive spring wire 31 and the electromagnet 27 via the electric wire 40. Here, electricity of the power source 200 may be supplied from the rechargeable battery, the primary dry cell or the rechargeable dry cell or may be supplied via the plug 130.

When an electric current is supplied to the field coil 36, the field coil 36 produces a magnetic force. The magnetic force forms a force in combination with a magnetic flux produced by the magnetized body 28, so the rotator 20 is rotated.

Due to the rotation of the rotator 20, the lamp unit 10 that is mounted to the rotator 20 is rotated in the same direction as that of the rotator 20.

Electricity of the external power source, which has been supplied to the conductive spring wire 31, is applied to the contact terminal 26 via the power supply terminal part 29. The electricity is then applied to the lamp 12 via the conductive wire 16 that is in contact with the contact terminal 26, so that lamp 12 emits light. In this case, the value of the electric current applied to the lamp is increased by the LED current controller 110 that is controlled by the volume switch 106, so the brightness of the lamp 12 can be controlled.

Further, a magnetic force is formed by an electric current supplied to the electromagnet 27, so a repulsive force is periodically formed between the permanent magnet 19 and the electromagnet 27, and the lamp unit 10 performs a periodic pendulating motion. In this case, the weight 18 provides the lamp unit 10 with a restoring force during the pendulating motion of the lamp unit 10.

Accordingly, the lamp unit 10 of the electric candle of the present invention performs pendulating motions in directions A, B and C as shown in FIG. 3 and FIGS. 4(A), 4(B) and 4(C), and also performs a rotating motion in a direction R. Thus, the lamp 12 provided in the upper part of the lamp unit 10 performs pendulating motions at angles of 360 degrees, so the lamp 12 can better approximate a natural flame irrespective of viewing directions of a user. Here, the lamp 12 may perform only a pendulating motion or may perform both a rotating motion and a pendulating motion simultaneously according to a switching position of the motion selecting switch 102.

In the embodiment, the magnetized body 28 is provided in the rotator 20 and the field coil 36 is provided in the rotator housing 30. However, the locations of the magnetized body 28 and the field coil 36 may be changed oppositely.

Further, in the embodiment, the electric candle has the bearing 38 that is installed in the bearing receiving part 32 of the rotator housing 30. However, it should be understood that another bearing may be installed between the inner container body 24 and the outer container body 34.

Further, the magnetized body 28 may be configured in the form of a brushless motor including a permanent magnet rotor and a stator which are installed inside the rotator housing 30, wherein the permanent magnet rotor has a plurality of field permanent magnets inserted in a laminated steel sheet yoke, and the stator has a polar part spaced apart from the outer circumferential surface of a polar part of the permanent magnet rotor by a predetermined gap, wherein the pole of the rotor is opposite to the pole of the stator.

Further, the lamp 12 may be operated for a lengthy period of time preset by the timer 104.

Further, when using a color changeable LED lamp as the lamp 12, the driving voltage of the lamp 12 may be changed by the color changing switch 108, and the lighting color of the lamp 12 may be changed between various colors, thereby forming various lighting moods.

Although a preferred embodiment of the present invention has been described for illustrative purposes, those skilled in the art will appreciate that various modifications, additions and substitutions are possible, without departing from the scope and spirit of the invention as disclosed in the accompanying claims.

INDUSTRIAL APPLICABILITY

As described above, the present invention provides a portable electric candle having a lamp pendulating and rotating simultaneously, which is controlled to induce a pendulating motion of the lamp and to induce the lamp to rotate separately from or simultaneously with the pendulating motion, and in which the brightness and color of light can be changed, so that the electric candle can accurately simulate an active flame.

Further, the present invention is advantageous in that the operating time of the lamp may be preset and the electric candle may use an internal power source or an external power source, so, when the electric candle uses the internal power source, the electric candle may be moved to a desired place so as to be used therein.

The invention claimed is:

1. A portable electric candle having a lamp pendulating and rotating simultaneously, comprising:

a lamp unit (10) including: a lamp (12) held by a conductive wire (16) of a wing (14) and emitting light by electricity supplied thereto from a power source, a weight (18) mounted to a lower end of the wing (14), and a permanent magnet (19) provided in a lower part of the weight (18) and corresponding to an electromagnet (27) of a rotator (20), wherein the lamp unit (10) performs a pendulating motion using both a magnetic force produced by an electric current applied to the electromagnet (27) and a repulsive force produced by the permanent magnet (19) and repeats the pendulating motion using a restoring force produced by the weight (18);

the rotator (20) including: a cylindrical base (22), an inner container body (24) extending upward from the cylindrical base (22) and having an opening (23) that is open upward, a contact terminal (26) placed in an upper end of the inner container body (24) and electrically connected to the conductive wire (16), the electromagnet (27) provided on a center of an upper surface of the cylindrical base (22), a magnetized body (28) mounted in an outer circumferential surface of the inner container body (24) and producing a magnetic flux, and a power supply terminal part (29) mounted to a lower part of the inner container body (24), wherein the rotator (20) is rotated by a force that is formed by a magnetic force of a field coil (36) of a rotator housing (30) in combination with the magnetic flux produced by the magnetized body (28);

the rotator housing (30) including: a bearing receiving part (32), an outer container body (34) extending upward from the bearing receiving part (32) and having a cylindrical opening (33) for receiving the rotator (20) therein, and the field coil (36) mounted on an inner circumferential surface of the outer container body (34), wherein the rotator housing (30) receives the rotator (20) therein, and induces a rotation of the rotator (20) therein; and a motion selecting switch (102) configured to select a motion of the lamp (12) in such a way that the lamp (12) performs one of a rotating motion and the pendulating motion selectively or performs both the rotating motion and the pendulating motion simultaneously.

2. The portable electric candle having the lamp pendulating and rotating simultaneously according to claim 1, further comprising:

a timer (104) configured to control an operating time of the lamp (12) during which the lamp (12) performs the rotating motion and the pendulating motion.

3. The portable electric candle having the lamp pendulating and rotating simultaneously according to claim 1, wherein the lamp (12) is a color changeable LED lamp configured to change lighting color using R (Red), G (Green) and B (Blue) colors.

4. The portable electric candle having the lamp pendulating and rotating simultaneously according to claim 3, wherein the lamp (12) is connected to an LED current controller (110) in such a way that the lamp (12) and the LED current controller (110) form a circuit capable of controlling brightness of the lamp (12) stepwisely.

5. The portable electric candle having the lamp pendulating and rotating simultaneously according to claim 1, wherein, to use the electric candle as a portable candle configured to be moved to a table in a marriage ceremony hall or to an event hall, a power source that supplies electricity to the conductive wire (16), the electromagnet (27) and the field coil (36) is a rechargeable battery, a primary dry cell or a rechargeable dry cell which is installed in a candle body (1).

6. The portable electric candle having the lamp pendulating and rotating simultaneously according to claim 1, wherein, to supply electricity of an external power source to the conductive wire (16), the electromagnet (27) and the field coil (36), a plug (130) is connected to the electric candle.

7. The portable electric candle having the lamp pendulating and rotating simultaneously according to any one of claims 2 to 6, further comprising:

a rotating shaft (29*a*) mounted to a central axis of the power supply terminal part (29), the rotating shaft (29*a*) being inserted into the rotator housing (30) and maintaining concentricity.

8. The portable electric candle having the lamp pendulating and rotating simultaneously according to any one of claims 2 to 6, further comprising:

a bearing (38) provided on an upper surface of the bearing receiving part (32) so as to support a rotation of the rotator (20).

9. The portable electric candle having the lamp pendulating and rotating simultaneously according to any one of claims 2 to 6, wherein the rotator housing (30) is provided with a conductive spring wire (31) that is in elastic contact with the power supply terminal part (29) of the rotator (20) so as to supply electricity of an external power source to the power supply terminal part (29).

* * * * *